United States Patent [19]

Dvorscak

[11] 4,368,673

[45] Jan. 18, 1983

[54] DISTRIBUTION MEANS FOR PARTITION SHEET ASSEMBLY

[75] Inventor: Richard P. Dvorscak, Portage, Ind.

[73] Assignee: Pullman Incorporated, Chicago, Ill.

[21] Appl. No.: 256,862

[22] Filed: Apr. 24, 1981

Related U.S. Application Data

[63] Continuation of Ser. No. 86,887, Oct. 22, 1979, abandoned.

[51] Int. Cl.[3] ..... B61D 7/00; B61D 17/00

[52] U.S. Cl. ..... 105/248; 105/404; 220/20.5; 298/24

[58] Field of Search ..... 105/247, 248, 358, 360, 105/406 R, 396, 404; 298/24, 27; 280/5 C, 5 D, 5 E; 220/20.5, 22, DIG. 24

[56] References Cited

U.S. PATENT DOCUMENTS

| | | | |
|---|---|---|---|
| 401,530 | 4/1889 | Zurcher | 105/248 |
| 784,817 | 3/1905 | Trapp | 105/360 |
| 1,226,647 | 5/1917 | Elder | 105/360 |
| 2,000,819 | 5/1935 | Burkhardt | 105/360 |
| 2,140,268 | 12/1938 | Moss | 105/406 R X |
| 3,040,785 | 6/1962 | Grindle | 220/22 X |
| 3,995,541 | 12/1976 | Coyle et al. | 105/248 X |

*Primary Examiner*—Randolph Reese
*Attorney, Agent, or Firm*—Richard J. Myers

[57] ABSTRACT

A partition sheet structure for covered hopper railway cars providing for even fill of commodity between compartments. The structure facilitates the filling operation, and prevents buckling caused by the uneven fills of the cars, while allowing the partition sheet structures to act in its capacity as a structural member of the car.

7 Claims, 3 Drawing Figures

DISTRIBUTION MEANS FOR PARTITION SHEET ASSEMBLY

This is a continuation of Ser. No. 086,887, filed Oct. 22, 1979, now abandoned.

BACKGROUND OF THE INVENTION

1. Field of the Invention

This invention pertains to a partition sheet assembly for use in covered hopper railway cars and in particular to a partition sheet assembly including distribution means for the even fill of the car.

2. Description of the Prior Art

The prior art includes partition sheet assemblies which act as compartment dividers, roof and side wall support elements and stiffening elements for the top framing bar within covered hopper railway cars.

The present invention is an improvement over the prior art by the inclusion of distribution means in the partition sheet assemblies providing for cross-flow of commodity between hopper compartments. The distribution means saves time and money in the filling operation, and prevents buckling of the assemblies while still performing its structural duties.

SUMMARY OF THE INVENTION

In the present invention covered hopper railway cars include a plurality of partition sheet assemblies which divide the cars into hopper compartments. The partition sheet assemblies also act as structural members within the cars.

During the filling of covered hopper cars each hopper compartment is individually filled with material. This is accomplished by filling one compartment, moving the car, filling the next compartment and so on until the car is filled to its designated capacity. This operation is time consuming and costly. It also produces the added problem of the partition sheet assembly buckling and bulging under the force created by having one hopper compartment filled with material while the adjacent compartment is empty.

To overcome the above stated problem and increase efficiency a distribution means is placed in the partition sheet assemblies. This provides for commodity to flow from one hopper compartment to the next without having to move the car. The distribution means also eliminates forces created by uneven loading culminating in bulging and buckling of the car.

DESCRIPTION OF THE PREFERRED EMBODIMENTS

Figure 1:
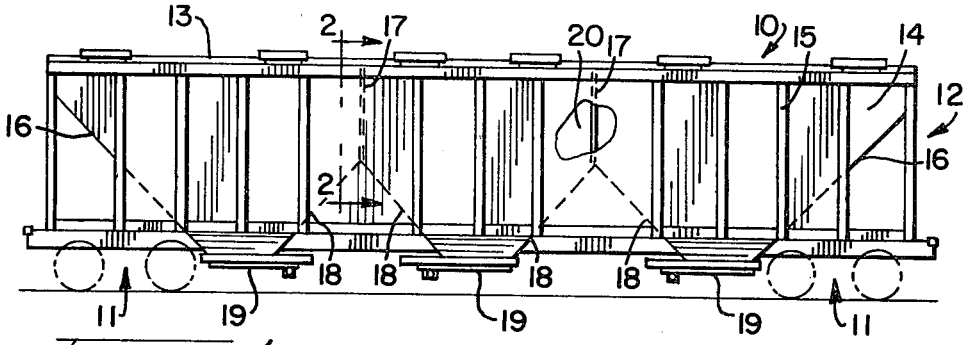
FIG. 1 is a side elevational view of a covered railway hopper car.

FIG. 1 discloses a covered railway hopper car generally designated by reference numeral 10, the car having wheel trucks 11 supporting a car body 12. The body 12 includes a roof structure 13 extending laterally between and connected to a pair of generally vertical transverse side walls 14 having conventional vertical posts 15. The side walls 14 are connected at their opposite ends to diagonally sloping end walls 16 connected to the roof structure 13 at its longitudinal opposite ends.

Partition sheet assemblies 17 extend generally vertically within the car body 12 laterally between and are connected to the side walls 14. The side walls 14 are connected to downwardly sloping sheets 18 leading to discharge openings 19. The partition sheet assemblies 17 end at the slope sheets 18 and divide the covered hopper car 10 into hopper compartments 20.

Figure 2:
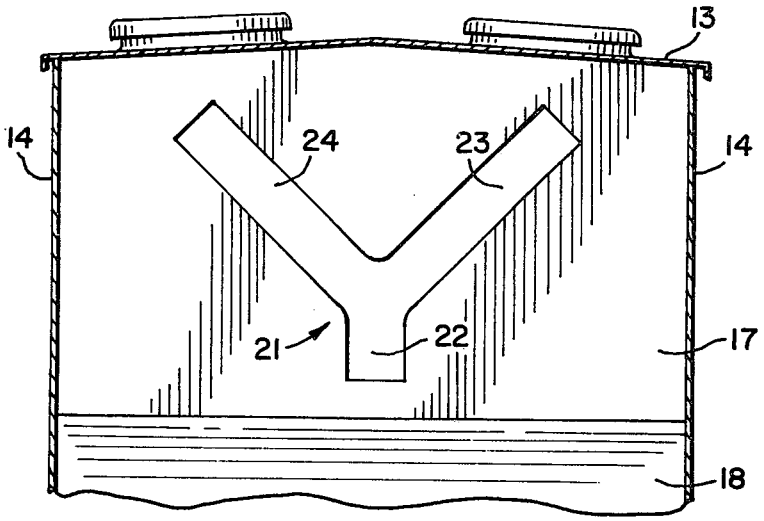
FIG. 2 is a section taken along line 2—2 of FIG. 1 disclosing one embodiment of the invention.

FIG. 2 discloses one embodiment of the invention of a partition sheet assembly 17 which includes a distribution means 21 comprising a slot means having a first slot 22 extending generally vertically from the lower portion of the partition sheet assembly 17 intersecting with a second slot 23 and a third slot 24 both extending from the first slot 22 generally diagonally therefrom in V-shaped configuration and on opposite sides thereof. The slot means 21 allows the commodity, as the car is being loaded, once it rises to the bottom of the first slot 22, to flow into the adjacent hopper compartment 20 and as the commodity rises to the second slot 23 and third slot 24 the flow of commodity to the adjacent compartment increases, thus obtaining an evenly filled hopper car.

Figure 3:
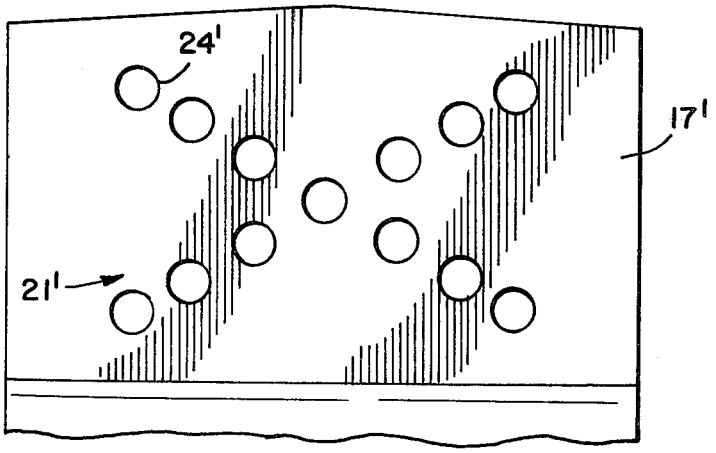
FIG. 3 is another modification of the present invention.

FIG. 3 reveals a second embodiment of the present invention and discloses a partition sheet assembly 17' including a distribution means 21' having a plurality of opening means 24' being disposed in a criss-cross linear relation within the partition sheet assembly 17. The criss-cross linear relation of the opening means 24' eliminates the uneven filling of the covered hopper railway car 10 by allowing the commodity to flow through the opening means 24' as the commodity arises within a hopper compartment 20 allowing the commodity to flow into an adjacent hopper compartment and being evenly distributed throughout the car.

The embodiments of the present invention described in FIGS. 2 and 3 allow for a cross-flow of commodity between hopper compartments 20 eliminating the forces which culminate in bulging and buckling of partition sheets during the filling operation of the railway cars. These embodiments save time and money during the filling operation by only having to fill one end of the car and having total communication throughout the car. These embodiments also allow the partition sheet assembly 17 to continue to function in the structural manner in which they were designed.

What is claimed is:

1. A covered railway hopper car having a body including a roof structure extending between and being connected to a pair of generally vertical transversely spaced side walls and having an opening to admit lading, a plurality of partition sheet assemblies extending generally vertically within said body being disposed between and connected to said side walls defining hopper compartments, the improvement comprising:

upwardly converging slope sheets at opposite sides of each partition sheet assembly and terminating in an apical structure at the lower edge thereof, said partition sheet assemblies including distribution means providing for communication and cross-flow of commodity between said hopper compartment, said partition sheet assemblies except for said distribution means being imperforate and the lower end of said distribution means extending proximate to the apical structure therebeneath, said distribution means providing opening means with first portions located at opposite upper lateral end regions of the associated partition sheet assembly and said first portions converging therefrom inwardly to an apex at the central portion of the partition sheet assembly, said opening means including a second portion extending from the apex into the lower region of said partition sheet assembly, the area of said opening means being the smallest midway between said side walls and spreading out therefrom laterally and vertically in a uniform arrangement to sift commodity from one side of the partition sheet assembly to the other in a predetermined pattern toward the center of the car, and said partition sheet assemblies being co-extensive and connected about their entire peripheries with the interior of the hopper car body thereby providing structural rigidification of the hopper car body while said distribution means provides communication and cross-flow of commodity between adjacent hopper compartments in a predetermined pattern.

2. The hopper car of claim 1, wherein, said distribution means comprises a Y-shaped opening.

3. The hopper car of claim 2 and, said Y-shaped opening having upper diverging legs and a lower vertical leg, and said upper legs being substantially longer than said lower leg.

4. The hopper car of claim 1 wherein said Y-shaped opening includes:

said first portions having means extending outwardly and upwardly from said apex.

5. The hopper car of claim 2 wherein said Y-shaped opening includes:

further opening means extending downwardly from said apex.

6. The hopper car of claim 1 wherein said distribution means includes:

said second portion comprises means for providing openings extending from said apex diverging outwardly and downwardly therefrom.

7. The hopper car of claim 6 wherein said second portion includes:

means cooperative with the first portions to form openings in the associated partition sheet assemblies having an X-shaped configuration.

* * * * *